US008748677B2

(12) United States Patent
Buchanan

(10) Patent No.: US 8,748,677 B2
(45) **Date of Patent: *Jun. 10, 2014**

(54) EXPANSION OF FUEL STREAMS USING MIXED HYDROCARBONS

(71) Applicant: Keith D. Buchanan, Media, PA (US)

(72) Inventor: Keith D. Buchanan, Media, PA (US)

(73) Assignee: Sunoco Partners Marketing & Terminals L.P., Philadelphia, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/772,680

(22) Filed: Feb. 21, 2013

(65) Prior Publication Data

US 2014/0130403 A1 May 15, 2014

Related U.S. Application Data

(60) Provisional application No. 61/725,336, filed on Nov. 12, 2012.

(51) Int. Cl.

| | |
|---|---|
| ***C10L 1/02*** | (2006.01) |
| ***C10L 1/18*** | (2006.01) |
| ***C10L 1/182*** | (2006.01) |

(52) U.S. Cl.
USPC ..... 585/14; 44/452; 44/436; 585/1; 141/9; 141/104

(58) Field of Classification Search
USPC ..... 422/105; 73/29.01; 585/1, 14; 44/452, 44/436, 451; 141/9, 104
See application file for complete search history.

(56) References Cited

U.S. PATENT DOCUMENTS

| | | | | |
|---|---|---|---|---|
| 5,004,850 | A * | 4/1991 | Wilson | 585/1 |
| 6,679,302 | B1 * | 1/2004 | Mattingly et al. | 141/104 |
| 2010/0175313 | A1 * | 7/2010 | Mattingly et al. | 44/451 |
| 2012/0216453 | A1 * | 8/2012 | Mattingly et al. | 44/451 |

* cited by examiner

*Primary Examiner* — Pamela H Weiss
(74) *Attorney, Agent, or Firm* — Clark G. Sullivan; Troutman Sanders LLP

(57) ABSTRACT

Methods and systems for blending multiple batches of mixed hydrocarbons into fuel streams downstream of the refinery are provided that do not compromise the octane value of the fuel and do not cause the volatility of the fuel to exceed volatilities imposed by government regulation.

38 Claims, 3 Drawing Sheets

BLENDING ARCHITECTURE OVERVIEW

EXPANSION OF FUEL STREAMS USING MIXED HYDROCARBONS

FIELD OF THE INVENTION

The present invention relates to methods and systems for expanding fuel streams downstream of a refinery using batches of mixed hydrocarbons that vary in terms of their hydrocarbon content, volatility or blended octane values. More particularly, the invention relates to the expansion of certified gasoline batches using batches of mixed pentanes or butane mixed with large amounts of other hydrocarbons.

BACKGROUND OF THE INVENTION

Since the advent of butane blending along pipelines and at petroleum tank farms, pipeline operators and gasoline distributors have been able to blend butane into the nation's gasoline pool in a manner that optimizes the quantity of butane added to the gasoline, without violating a geographic region's volatility requirements. Methods of performing these blending operations are described, for example, in U.S. Pat. Nos. 6,679,302, 7,631,671 and 8,192,510 to Mattingly and Vanderbur. Butane is especially useful in these blending operations because of its consistent physical contribution to volatility and octane in a blended gasoline pool.

One of the problems with these methods is that the quantity of butane that can be added to a fuel stream is limited, due to the high volatility of butane. Indeed, no more than 3-5% butane is typically added to a fuel stream even in high-blending seasons. There are other sources of hydrocarbons that increase the volatility of fuels less than butane, and that conceivably could be added in greater quantities, but most of these other sources suffer from other disadvantages, such as variability in hydrocarbon content and an unpredictable effect on octane. Mixed pentanes, raw butane, and other hydrocarbons that contain n-pentane are a good example. The abundance of these hydrocarbons is increasing as new sources of energy are discovered around the world. However, these hydrocarbons cannot be readily substituted for butane due to variability in their hydrocarbon content, and uncertainty about how much impact they will have on the volatility and octane of the fuel stream. This is especially true for hydrocarbon additives that contain large amounts of n-pentane, which has a neat octane value of only 65, and whose effect on fuel octane is unknown.

Given the number and types of fuels transmitted through our nation's pipelines, and the eventual blending of many fuel streams with ethanol, further complications arise from variability within the fuel stream itself. It is well known that the quantity of aromatics in a gasoline batch can have a significant impact on the Reid vapor pressure (RVP) blending values of non-aromatic hydrocarbons, and that RVP typically increases with the aromatic content of the gasoline, a so-called "aromatic effect." These variations make it difficult to blend hydrocarbons into fuel streams, especially fuel streams that have been blended to meet demanding certification requirements, including strict limits on volatility and octane. This is especially true when inconsistent additives such as mixed pentanes or raw butane, which vary in terms of volatility and octane, are used in the blending process.

What is needed are new methods that permit less well defined hydrocarbons such as mixed pentanes and raw butane to be blended into fuels downstream of the refinery. Blending methods originally developed for butane, that project the impact of the blending on the volatility of the blended fuel, must be adapted to permit blending of n-pentane, mixed pentanes, and raw butane, into fuels received from the refinery, without negatively affecting the volatility or octane value of the fuels received from the refinery.

SUMMARY OF THE INVENTION

In the course of investigating methods of enriching fuel streams using hydrocarbon additives such as mixed pentanes and raw butane, the inventor has made several unexpected findings and discoveries that permit, for the first time, the blending of such hydrocarbons into fuel streams, even when they contain large proportions of n-pentane. Their first discovery centers on the relationship between n-pentane and isopentane when blended into hydrocarbon fuels. While n-pentane might normally be expected to depress the octane of hydrocarbon fuels due to its 65 octane value, the inventor has discovered that this depression can be offset almost completely by including with the n-pentane a sufficient amount of isopentane. There is, in effect, a synergism observed when isopentane and n-pentane are combined in an additive fuel stream, particularly above certain minimum ratios of isopentane to n-pentane.

Based on this discovery there is provided, in a first principal embodiment, a method for making fuel enriched by mixed pentanes comprising the steps: (a) providing a fuel blending unit characterized by (i) a first enclosed conduit transmitting a fuel stream, (ii) a second enclosed conduit transmitting an additive stream, wherein the additive stream comprises n-pentane and isopentane, and an outlet in the second enclosed conduit forming a fluid connection with an inlet in the first enclosed conduit, (b) providing (i) a volatility for the additive stream (the "additive stream volatility"), (ii) a flow rate for the fuel stream (the "fuel stream flow rate"), (iii) an octane value for the fuel stream (the "fuel stream octane value"), and (iv) a maximum blended volatility for the fuel stream (the "maximum blended volatility"), (c) measuring the fuel stream for its actual volatility (the "fuel stream volatility"), (d) calculating a rate (the "additive stream flow rate") at which the additive stream can be added to the fuel stream so as not to exceed the maximum blended volatility, wherein the calculating is based upon (i) the fuel stream volatility, (ii) the additive stream volatility, and (iii) the fuel stream flow rate, and (e) adding the additive stream to the fuel stream at the additive stream flow rate at the fluid connection to make pentane enriched fuel having a final octane value, wherein the additive stream comprises isopentane and n-pentane in a ratio and quantity that will not cause the final octane value to drop below the fuel stream octane value.

The inventor has also discovered a subtle trend toward reduced octane when mixed pentanes are added to a fuel stream, particularly as the volume of pentanes blended into the fuel stream increases. While subtle, this octane reduction is enough to preclude or severely limit the blending of mixed pentanes in some environments. The inventor has overcome this problem with their discovery that ethanol, when mixed with a pentane-enriched fuel stream, can reverse the trend towards lower octane values as the quantity of n-pentane is added, and actually increase the octane of the fuel stream more than if the n-pentane were never added. I.e., the blending octane number of n-pentane is larger when ethanol is added to the fuel, and the blending octane number of the ethanol is larger when n-pentane is added to the fuel.

Therefore, in a second principal embodiment, the invention provides a method for making mixed-pentane enriched fuel without depressing the octane of the fuel, comprising the steps (a) providing a fuel blending unit characterized by (i) a first enclosed conduit transmitting a fuel stream, (ii) a second enclosed conduit transmitting an additive stream, wherein the additive stream comprises mixed-pentane, and (iii) an outlet in the second enclosed conduit forming a fluid connection with an inlet in the first enclosed conduit, (b) providing: (i) a volatility for the additive stream (the "additive stream volatility"), (ii) a flow rate for the fuel stream (the "fuel stream flow rate"), (iii) an octane value for the fuel stream (the "fuel stream octane value"), and (iv) a maximum blended volatility for the fuel stream (the "maximum blended volatility"), (c) measuring the fuel stream for its actual volatility (the "fuel stream volatility"), (d) calculating a rate (the "additive stream flow rate") at which the additive stream can be added to the fuel stream so as not to exceed the maximum blended volatility, wherein the calculating is based upon: (i) the fuel stream volatility, (ii) the additive stream volatility, and (iii) the fuel stream flow rate, (e) adding the additive stream to the fuel stream at the additive stream flow rate at the fluid connection to make pentane enriched fuel, and (f) adding ethanol to the pentane enriched fuel in an amount sufficient to overcome the depression in octane caused by the n-pentane. The sufficient amount of ethanol can be a fixed amount added to multiple batches of fuel, such as 10% or 15% of the total volume of the fuel, as long as the amount is adequate to overcome the n-pentane induced octane reduction, or it can constitute the minimum amount adequate to overcome the n-pentane induced octane reduction for a particular batch.

Even with the improvements in octane values that the inventor has made, the variability that occurs when fuels are blended with mixed pentanes or raw butane remains a significant problem. Variations in the content of fuels produced at the refinery, and variations in additive hydrocarbon streams, can cause significant variability in the octane and volatility of the resulting fuel streams. To overcome this problem, the inventor has studied the relationship between volatility and octane when mixed pentane and raw butane streams are added to hydrocarbon fuels, and have discovered that the volatility and octane of the blended fuel can be simultaneously controlled by setting a maximum volatility for the additive hydrocarbon stream, and using that maximum volatility as an assumed volatility in calculations that project the impact of the additive hydrocarbons on the fuel stream. By controlling the volatility of the additive hydrocarbon stream below a maximum value, and using that maximum value in calculations to determine how much of the additive hydrocarbon can be added to the fuel stream, the inventor can ensure the production of blended fuels that consistently meet demanding volatility and octane requirements. This is particularly true for additive fuel stream comprised predominantly of mixed pentanes or raw butane.

Therefore, in still another embodiment, the invention provides a method for blending mixtures of butane and pentane into a primary fuel stream (the "fuel stream") comprising: (a) providing (i) a mixed hydrocarbon stream (the "additive stream") comprising a plurality of heterogeneous batches of light hydrocarbons, (ii) a fuel blending unit characterized by a first enclosed conduit transmitting the fuel stream, a second enclosed conduit transmitting the additive stream, and an outlet in the second enclosed conduit forming a fluid connection with an inlet in the first enclosed conduit, (b) providing (i) a flow rate for the fuel stream (the "fuel stream flow rate"), (ii) an octane value for the fuel stream (the "fuel stream octane value"), (iii) a designated volatility for the additive stream, for each of the plurality of light hydrocarbon batches, that exceeds the actual volatility of the batches, (iv) a maximum blended volatility for the fuel stream (the "maximum blended volatility"), (c) measuring the fuel stream for its actual volatility (the "fuel stream volatility"), (d) calculating a rate (the "additive stream flow rate") at which the additive stream can be added to the fuel stream so as not to exceed the maximum blended volatility, wherein the calculating is based upon: (i) the fuel stream volatility, (ii) the designated volatility of the additive stream, and (iii) the fuel stream flow rate, (e) adding the additive stream to the fuel stream at the additive stream flow rate at the fluid connection to make fuel enriched by mixed hydrocarbons.

Additional advantages of the invention are set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DESCRIPTION OF THE INVENTION

Definitions and Use of Terms

Figure 1:
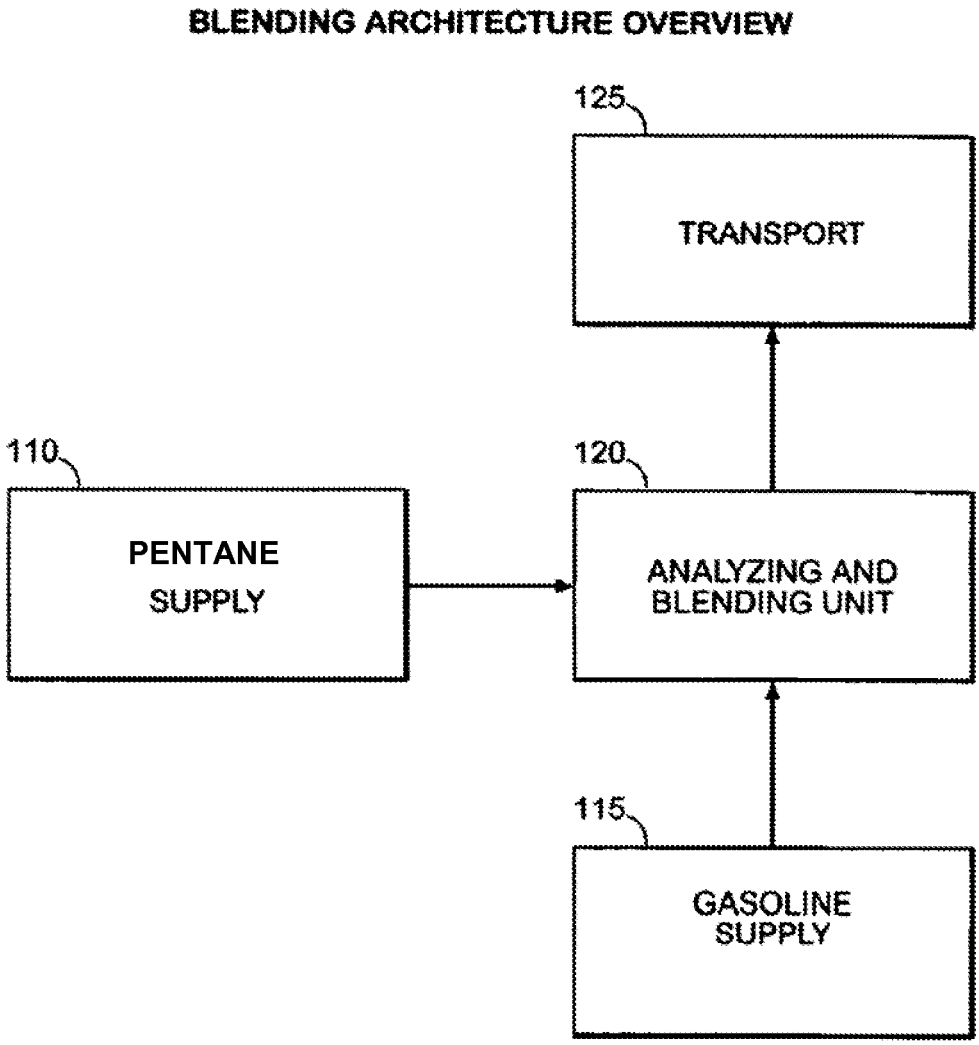
FIG. 1 is a functional block diagram illustrating an overview of the architecture of an exemplary system for blending mixed hydrocarbons into fuel streams.

"ASTM" refers to the American Society for Testing and Materials. Unless otherwise indicated, when reference is made to an ASTM standard herein, it is made in reference to the ASTM standard in effect on Oct. 1, 2012, and the ASTM standard is incorporated herein by reference.

"Butane" refers to isobutane and n-butane and mixtures thereof, but preferably refers to n-butane. "Raw butane" means any stream or pool of butane that contains less than 99%, 98% or 95% butane. Unless otherwise stated herein, raw butane contains greater than 50% and less than 95% butane, the remainder essentially constituting other hydrocarbons.

"Certified gasoline" is fuel meeting the standards of ASTM Standard Specification Number D 4814-01a ("ASTM 4814"), and should be distinguished from in-process gasoline streams at a refinery that have not been released from the refinery and have not been certified. The specifications for different types of gasoline set forth in ASTM 4814 vary based on a number of parameters affecting volatility and combustion such as weather, season, geographic location and altitude. For this reason, gasoline types produced in accordance with ASTM 4814 are broken down into volatility categories AA, A, B, C, D and E, and vapor lock protection categories 1, 2, 3, 4, 5, and 6, each category having a set of specifications. Certified gasoline also includes a gasoline certified to meet ASTM 4814 upon the addition of a designated quantity of ethanol.

"Fuel" refers to any refined combustible petroleum product that flows through a petroleum pipeline. The term includes any liquid that can be used as fuel in an internal combustion engine, with or without addition of ethanol, non-limiting examples of which include fuels with an octane rating between 80 and 95, fuels with an octane rating between 80 and 85, fuels with an octane rating between 85 and 90, and fuels with an octane rating between 90 and 95. The term includes products that consist mostly of aliphatic components, as well as products that contain aromatic components and branched hydrocarbons such as iso-octane. The term thus includes all grades of conventional gasoline, reformulated gasoline ("RFG"), diesel fuel, biodiesel fuel, jet fuel, heating oil, kerosene, and transmix. The term also includes blendstock for oxygenate blending ("BOB"), which is typically used for blending with ethanol. BOBs include RBOB (reformulated gasoline blendstock), PBOB (premium gasoline blendstock), CBOB (conventional gasoline blendstock), subgrade gasoline, and any other blendstock used for oxygenate or ethanol blending. BOBs are preferably used to create a BOB:ethanol blend at a ratio of from 9:1 to 1:1, preferably from 9:1 to 3:1, most preferably about 9:1 or 85:15.

"Hydrocarbon" refers to any linear, branched, or cyclic molecule, aliphatic or aromatic, saturated or unsaturated, composed primarily of hydrogen and carbon. Preferred hydrocarbons for the additive stream discussed herein are straight and branched alkanes comprising from 2 to 10 carbon units, from 3 to 8 carbon units, or from 4 or 5 carbon units. Mixed hydrocarbons refers to a mixture of 2 or more hydrocarbon species, each species preferably making up at least 5, 10 or 20% of the hydrocarbon pool. Mixed hydrocarbons thus include mixtures of C3-C8 straight and branched hydrocarbons, butane and pentane, mixtures of n-pentane and isopentane, and mixtures of butane, n-pentane and isopentane.

"Information processing unit" or "IPU" when used herein, refers to a data processing system which can receive, retrieve, store, process, and output data. The information processing unit processes data which has been captured and encoded in a format recognizable by the data processing system. The information processing unit communicates with other information processing unit(s), information database(s), component(s), system(s) and device(s) encompassed by the methods and systems of the present invention.

"Informational database," when used herein, refers to a data storing system which can receive, store and output data. The informational database communicates with other informational database(s), IPU(s), component(s), system(s) and device(s) encompassed by the methods and systems of the present invention.

"Mixed pentanes" refers to a stream or pool of pentanes that contains n-pentane in addition to isopentane. The stream or pool might also contain neopentane, although this compound is quite rare in natural supplies. The pentanes can be part of a larger hydrocarbon pool, as in raw butane, but preferably make up at least 10%, 30%, 50%, 70%, 90% or 95% of the total hydrocarbon pool at issue. The pentanes can be present in any ratio that satisfies the performance requirements of this invention, but preferably contain from 20% or 30% up to 100% isopentane, with the balance being n-pentane. In any of the various embodiments and subembodiments discussed herein, the mixed pentanes can be characterized by a minimum ratio of isopentane to n-pentane of 1:5, 2:5, 3:5, 4:5, 5:5, 10:5, or greater, an isopentane to n-pentane ratio of from 30:70 to 95:5, from 30:70 to 60:40, or an isopentane to n-pentane ratio of from 40:60 to 50:50.

"Rate" when used herein can refer to an absolute rate, such as gallons per minute, or a relative rate, such as the ratio at which the additive stream should be added to a fuel stream traveling at a given flow rate.

"RVP" is an abbreviation for Reed Vapor Pressure.

"RVP blend value" or "blend RVP" is the effective RVP of a composition when blended into a fuel mixture. A blend RVP value represents the composition's contribution to the RVP of a mixture such that the RVP for the mixture equals the sum of each component's blend RVP multiplied by that component's volume fraction. For example, for a fuel mixture of [A] and [B], the RVP can be calculated by the following formula:

$$(\mathrm{RVP}_{blend} \text{ of } [A]*\text{vol. fraction of } [A])+(\mathrm{RVP}_{blend} \text{ of } [B]*\text{vol. fraction of } [B])$$

In the same manner, octane blend value, volatility blend value, or any other physical property can be evaluated based on a component's contribution to the physical property observed in a resulting mixture.

"Volatility" refers to the potential for a liquid substance to vaporize. There are three principal methods for assessing the volatility of hydrocarbons, and either one or a combination of any two or all three are suitable for practicing the current invention: (1) measuring the vapor to liquid ratio, (2) measuring the vapor pressure, and (3) measuring the distillation temperature. The Reid method is a standard test for measuring the vapor pressure of petroleum products. RVP is related to true vapor pressure, but is a more accurate assessment for petroleum products because it considers sample vaporization as well as the presence of water vapor and air in the measuring chamber. RVP of conventional gasoline is preferably measured in accordance with ASTM Standard Specification D 5191-04a ("D 5191"). For measuring the RVP of reformulated gasoline, ASTM standard method D 5191-07 can be used. The following correlation can also be used to satisfy EPA regulations:

$$\mathrm{RVP}_{EPA}=(0.956*\mathrm{RVP}_{ASTM})-2.39 \text{ kPa}$$

For measuring the temperature at which a given percentage of gasoline is volatilized, ASTM standard D 86-07b, should be used. This method measures the percentage of a gasoline sample that evaporates, as a function of temperature, as the sample is heated up under controlled conditions. $T_D$ refers to the temperature at which a given percentage of gasoline volatilizes using ASTM standard D 86-07b as the test method, T(50) refers to the temperature at which 50% of gasoline volatilizes using ASTM standard D 86-07b as the test method, etc.

Ratios, quantities and rates of liquid flows expressed herein, unless otherwise specified, are expressed in terms of volume, and are preferably measured at room temperature (25° C.) and atmospheric pressure.

When the singular forms "a," "an" and "the" or like terms are used herein, they will be understood to include plural referents unless the context clearly dictates otherwise. Thus, for example, reference to "a hydrocarbon" includes mixtures of two or more such hydrocarbons, and the like. The word "or" or like terms as used herein means any one member of a particular list and also includes any combination of members of that list.

Throughout the description and claims of this specification, the word "comprise" and variations of the word, such as "comprising" and "comprises," means "including but not limited to," and is not intended to exclude, for example, other additives, components, integers or steps.

When ranges are given by specifying the lower end of a range separately from the upper end of the range, it will be understood that the range can be defined by selectively combining any one of the lower end variables with any one of the upper end variables that is mathematically possible.

The invention is defined in terms of three principal embodiments. When an embodiment or subembodiment other than the principal embodiment is discussed herein, it will be understood that the embodiment or subembodiment can applied to further limit any three of the principal embodiments.

When data or a signal is referred to herein as being transmitted between two IPUs or an IPU and an information database, or other words of like import such as "communicated" or "delivered" are used, it will be understood that the transmission can be indirect, as when an intermediate IPU receives and forwards the signal or data. It will also be understood that the transmission can be passive or active.

Discussion

The inventor has developed new methods for enriching fuel streams downstream of a refinery without compromising the properties of the refinery fuel, using mixed hydrocarbons that contain n-pentane and other difficult to blend hydrocarbons such as raw butane. The methods are surprisingly versatile, permitting sequential blending of heterogeneous batches of mixed hydrocarbons into a fuel stream, even though the batches might vary significantly in terms of n-pentane content, volatility, and octane blend value.

The invention supports a number of embodiments, each of which are described in greater detail below. Unless otherwise specified, each of the following embodiments can be implemented at any point along a petroleum pipeline—i.e. at the rack, where gasoline is unloaded onto transport tanker trucks, along a consolidated pipeline that transmits multiple types of gasoline from different sources such as refineries or ports, and along a pipeline that transmits only one type of gasoline (as in a line that transmits only one type of gasoline to an aboveground storage tank). The tank farm may be a terminal gasoline tank farm (where tanker trucks are filled), an intermediate gasoline tank farm (from which gasoline is distributed to multiple end locations), or a combined use tank farm (that serves as an intermediate point and a terminal point). The invention provides methods of blending and the system components for blending, and it will be understood that each method embodiment has a corresponding system embodiment, and that each system embodiment has a corresponding method embodiment.

In a first principal embodiment, the invention relates to the use of isopentane to overcome the poor octane of n-pentanes when blended into fuel streams. In this embodiment, the invention provides a method for making fuel enriched by mixed pentanes by balancing the ratio of isopentane and n-pentane, comprising the steps: (a) providing a fuel blending unit characterized by (i) a first enclosed conduit transmitting a fuel stream, (ii) a second enclosed conduit transmitting an additive stream, wherein the additive stream comprises n-pentane and isopentane, and (iii) an outlet in the second enclosed conduit forming a fluid connection with an inlet in the first enclosed conduit, (b) providing (i) a volatility for the additive stream (the "additive stream volatility"), (ii) a flow rate for the fuel stream (the "fuel stream flow rate"), (iii) an octane value for the fuel stream (the "fuel stream octane value"), and (iv) a maximum blended volatility for the fuel stream (the "maximum blended volatility"), (c) measuring the fuel stream for its actual volatility (the "fuel stream volatility"), (d) calculating a rate (the "additive stream flow rate") at which the additive stream can be added to the fuel stream so as not to exceed the maximum blended volatility, wherein the calculating is based upon (i) the fuel stream volatility, (ii) the additive stream volatility, and (iii) the fuel stream flow rate, and (e) adding the additive stream to the fuel stream at the additive stream flow rate at the fluid connection to make pentane enriched fuel having a final octane value, wherein the additive stream comprises isopentane and n-pentane in a ratio and quantity that will not cause the final octane value to drop below the fuel stream octane value.

In any of the principal embodiments of the invention, isopentane can be used to overcome the negative octane effect induced by n-pentane. Suitable ratios of isopentane to n-pentane to prevent the octane value in a fuel stream from dropping are 1:4, 1:3, 1:2, 1:1 and greater. Suitable volumes of mixed pentanes that can be added to the fuel stream if these ratios are observed, without negatively affecting the octane value of the fuel, are from 0.1 to 20%, 1 to 15%, or 3 to 12% mixed pentanes based on the volume of the fuel stream.

In a second principal embodiment, the invention provides a method for overcoming the octane depression induced by n-pentane by adding ethanol to the fuel along with the mixed pentanes, either before or after the mixed pentanes or at the same time. In this embodiment, the invention comprises the steps: (a) providing a fuel blending unit characterized by (i) a first enclosed conduit transmitting a fuel stream, (ii) a second enclosed conduit transmitting an additive stream, wherein the additive stream comprises n-pentane, and (iii) an outlet in the second enclosed conduit forming a fluid connection with an inlet in the first enclosed conduit, (b) providing: (i) a volatility for the additive stream (the "additive stream volatility"), (ii) a flow rate for the fuel stream (the "fuel stream flow rate"), (iii) an octane value for the fuel stream (the "fuel stream octane value"), and (iv) a maximum blended volatility for the fuel stream (the "maximum blended volatility"), (c) measuring the fuel stream for its actual volatility (the "fuel stream volatility"), (d) calculating a rate (the "additive stream flow rate") at which the additive stream can be added to the fuel stream so as not to exceed the maximum blended volatility, wherein the calculating is based upon: (i) the fuel stream volatility, (ii) the additive stream volatility, and (iii) the fuel stream flow rate, (e) adding the additive stream to the fuel stream at the additive stream flow rate at the fluid connection to make n-pentane enriched fuel, and (f) adding ethanol to the pentane enriched fuel in an amount sufficient to overcome the depression in octane caused by the n-pentane.

Ethanol can be added in any of the principal embodiments of the invention to overcome the negative impact of n-pentane. Amounts of ethanol adequate to overcome the n-pentane induced octane depression are generally greater than 2%, 5%, 10% or 15% of the final volume of the n-pentane blended fuel, and typically less than 40%, 30% or 20%. Ethanol is preferably added in an amount of 10% or 15% based on the volume of the blended fuel. The ratio of mixed pentanes added, relative to ethanol, is preferably from 1:5, 1:4, 1:3, or 1:2 to 2:1, 3:1, 4:1, or 5:1, these mixed pentanes are preferably composed of at least 20% or 30% isopentane, up to 100% isopentane, with the balance comprising n-pentane. In a preferred embodiment the mixed pentanes comprise isopentane and n-pentane in a ratio of from 20:80 to 95:5 or from 30:70 to 80:20.

A third principal embodiment relates to the heterogeneous character of the batches of hydrocarbons in the additive stream, and methods for blending these heterogeneous batches into the fuel stream without negatively affecting the volatility or octane of the fuel, by using a designated volatility for the additive stream. For example, in a raw butane stream, the designated volatility might be an RVP of 55 psi; in a mixed pentane stream, the designated volatility on an RVP basis will likely vary between 16 and 35 psi depending on the proportion of each pentane in the mixture.

In this embodiment, the invention provides a method for blending heterogeneous batches of butane and pentane into a fuel stream comprising: (a) providing (i) a mixed hydrocarbon stream (the "additive stream") comprising a plurality of heterogeneous batches of mixed hydrocarbons, (ii) a fuel blending unit characterized by a first enclosed conduit transmitting the fuel stream, a second enclosed conduit transmitting the additive stream, and an outlet in the second enclosed conduit forming a fluid connection with an inlet in the first enclosed conduit, (b) providing (i) a flow rate for the fuel stream (the "fuel stream flow rate"), (ii) an octane value for the fuel stream (the "fuel stream octane value"), (iii) a designated volatility for the additive stream, for each of the plurality of light hydrocarbon batches a designated volatility for the additive stream, for each of the plurality of light hydrocarbon batches, that exceeds the actual volatility of the batches, (iv) a maximum blended volatility for the fuel stream (the "maximum blended volatility"), (c) measuring the fuel stream for its actual volatility (the "fuel stream volatility"), (d) calculating a rate (the "additive stream flow rate") at which the additive stream can be added to the fuel stream so as not to exceed the maximum blended volatility, wherein the calculating is based upon: (i) the fuel stream volatility, (ii) the designated volatility of the additive stream, and (iii) the fuel stream flow rate, (e) adding the additive stream to the fuel stream at the additive stream flow rate at the fluid connection to make enriched fuel by mixed hydrocarbons.

The use of a designated volatility when an additive stream comprises heterogeneous batches can be implemented in any of the principal embodiments of the present invention. The heterogeneity of the batches that make up the additive stream can be calculated in terms of hydrocarbon content, butane content, pentane content, n-pentane content, ratio of butane to pentane, blend octane value, or volatility. In a preferred embodiment, the batches include at least two hydrocarbon species that comprise greater than 5%, 10%, 20%, or 40% of the total hydrocarbon pool, and that vary among batches by more than 2%, 5%, 10%, 20%, or even 50% in terms of the content of at least two hydrocarbon species, the ratio of butane to pentane, the ratio of n-pentane to isopentane, the blend octane value, or the volatility (preferably RVP). A particularly preferred additive stream is raw butane comprising greater than 50% butane and greater than 30% pentanes (preferably mixed pentanes comprising isopentane and n-pentane at a ratio of 60:40 to 30:70).

The calculation of the additive stream flow rate is a common feature of all three principal embodiments and is based on at least three variables (the fuel stream flow rate, the fuel stream volatility, and the additive stream volatility), and at least one constraint (the maximum volatility of the blended fuel stream). As noted above, the additive stream volatility can be measured periodically or it can be a designated value.

The calculation of the additive stream flow rate is also preferably constrained by a maximum additive flow rate that will not cause the octane value of the fuel stream to decrease, or the final octane value to decrease when the fuel is subsequently blended with ethanol. I.e., the logic only allows blending to the lower of the maximum blended volatility or the maximum addition rate. One way to define a maximum additive flow rate is to study the impact of a range of additive streams on the octane and volatility of defined fuel streams, and to establish an outer limit on the rate or ratio of addition based on the studies. This approach can be used even when the fuel stream is eventually blended with ethanol, by studying the impact on octane and volatility of the additive fuel streams after ethanol is added. In various sub-embodiments, the maximum addition rate is less than or equal to 20%, 15%, 12%, or even 10%, based on the flow rate of the fuel stream. The actual addition rate of the additive stream, especially when constrained by the maximum addition rate, is also less than or equal to 20%, 15%, 12%, or 10%, but typically greater than 2%, 3% or 5%.

The precise logic for determining the rate of adding the additive stream to the fuel stream is not critical to the invention and could be determined simply by direct volumetric averaging of the volatility of the additive stream and the fuel stream. However, it has been noted in the literature that volumetric averaging can yield low estimates of resultant volatility when hydrocarbons are blended, especially when the amount of mixed hydrocarbons added is less than 25% of the total blend. More precise methods for determining blend ratios are set forth in "How to Estimate Reid Vapor Pressure (RVP) of Blends," J. Vazquez-Esparragoza, Hydrocarbon Processing, August 1992; and "Predict RVP of Blends Accurately," W. E. Stewart, Petroleum Refiner, June 1959; and "Front-End Volatility of Gasoline Blends," N. B. Haskell et al., Industrial and Engineering Chemistry, February 1942, the disclosures from each being hereby incorporated by reference as if fully set forth herein.

Various types of equipment can be used for measuring the volatility of the various streams, such as the Grabner unit manufactured by Grabner Instruments. This unit is a measuring device capable of providing Reid vapor pressure and vapor to liquid ratio data for a gasoline sample typically within 6-11 minutes of introducing the sample to the unit. The Distillation Process Analyzer (DPA) manufactured by Bartec could also be used. The DPA is a measuring device capable of provided a distillation temperature for a gasoline sample, typically within about 45 minutes of introducing the sample to the unit. These units can measure the volatility of the additive stream, the fuel stream, or the resultant blend for quality control when quality control is of concern.

When blending on a pipeline, the flow rate of the fuel stream should be measured periodically for use in the logic that calculates the additive stream flow rate. In other applications, such as rack blending, the flow rate is fixed based on the displacement of the pump used to transmit the fuel stream, or divisible based on the number of pumping outlets fed by a single pump, and this fixed rate can be used in the calculation. The flow rate can be measured upstream or downstream of the fluid connection between the fuel and additive streams, and is preferably performed upstream of the fluid connection. When the fuel stream flow rate is measured downstream of the fluid connection, a correction factor equaling the flow rate of the additive stream may be applied to the fuel stream flow rate so that the actual flow rate upstream of the fluid connection can be used when calculating the additive stream flow rate.

The methods can be performed across a range of operating conditions and physical environments. This presents a problem because the logic used to calculate addition rates for the additive stream is typically premised on molar rates of addition, whereas flow rate data is usually volumetric. As a consequence, the flow rates input into the blending logic must be normalized to account for temperature variations in the fuel and additive streams, and the additive flow rate calculated by the blending logic must be adjusted based on the actual temperature of the fuel and additive streams. While the normalization factors could differ depending on the actual content of the fuel or additive stream, they are typically selected based on conservative estimates of the degree of expansion or contraction that occurs at a given temperature, within the range of hydrocarbon contents permitted by the specifications applicable to the fuel and additive streams. The use of normalization factors in this manner further supports the use of heterogeneous batches of additive in the blending process.

In practical terms, this normalization process is carried out by the following additional steps: (i) periodically measuring the temperature of the additive stream, and (ii) calculating the additive stream flow rate based upon the temperature of the additive stream. Alternatively or in addition, the normalization process includes the following additional steps: (i) periodically measuring the temperature of the fuel stream, and (ii) calculating the additive stream flow rate based upon the temperature of the fuel stream.

In like manner, volatility measuring step (c) can be performed either upstream or downstream of the fluid connection. When, however, the volatility is measured downstream, the logic described above for calculating the additive stream flow rate will need to be adapted to a downstream feedback control format. Such formats are well known in the field of chemical engineering as described, for example, in Ramagnoli and Palazoglu, Introduction to Process Control (2d Ed.) (2012), the contents of which are hereby incorporated by reference. In the downstream control format, the control system will use a control calculation algorithm that uses the measured and desired volatility to determine a correction to the process operations, in this case an adjustment to the additive stream flow rate, since the fuel stream flow rate and fuel stream volatility are typically not under the operator's control.

Generally speaking, the additive stream is made up of any combination of mixed hydrocarbons that has a positive RVP blend value on the fuel stream being expanded. In addition, when blending into a certified gasoline stream, the additive stream preferably will not cause the fuel stream to violate the standards for finished gasoline prescribed in ASTM 4814. The additive stream is typically made up of a plurality of batches, each of which is independently characterized by a significant mixed pentane component (i.e. greater than 20%, 30%, 40%, 50% or 60%), a significant butane component (i.e. greater than 20%, 30%, 40%, 50% or 60%), or a significant content of butane and mixed pentanes (i.e. greater than 50%, 65%, 80%, or 95%). When mixed pentanes are present, they are preferably present predominantly as isopentane and n-pentane, at a ratio of from 5:1, 4:1, 3:1, 2:1, or 1.5:1 to 1:5, 1:4, 1:3, 1:2 or 1:1.5. In a particularly preferred embodiment, the additive stream comprises isopentane and n-pentane at a ratio of from 30:70 to 95:5, 30:70 to 60:40 or from 40:60 to 50:50.

The additive batches are preferably heterogeneous, as described above. The isopentane to n-pentane ratio is preferably enforced by setting limits on the minimum ratio of isopentane to n-pentane in the additive stream. This can be done either directly through an express limit on the ratio or indirectly through specifications on the total allowable amounts of these hydrocarbons in the additive stream. Any batches that violate the ratio or specifications would be detected during routine measurements, rejected and not used in the blending process.

In an in-line system, the fuel stream will typically comprise a plurality of different batches of ASTM 4814 certified gasoline that differ in terms of (i) volatility depending on the time of year and ultimate destination for the batch, and (ii) octane depending on whether the gasoline is dispensed as regular or premium gasoline, and (iii) octane blend value when the batch is destined for mixing with ethanol. The fuel stream is also preferably characterized by batches of other fuels such as propane, diesel, jet fuel and transmix.

Consideration to the ratio of isopentane to n-pentane should also be given when the fuel stream is destined for eventual enrichment by ethanol, and potentially other low molecular weight alcohols (C2-C8) such as butanol and isobutanol. Because ethanol typically increases the octane of hydrocarbons when added to a hydrocarbon fuel stream, refineries typically deliver fuel in which the octane value is intentionally below the target fuel octane value that results once the ethanol is blended. In these applications, the ratio of isopentane to n-pentane must continue to be controlled to ensure that the n-pentane does not negatively impact the target fuel octane value.

Therefore, any of the foregoing embodiments can further be characterized by this method, wherein (i) the fuel stream is intended for ethanol enrichment with a fixed amount of ethanol, thereby creating an ethanol enriched fuel stream, wherein the ethanol enrichment of the fuel stream without adding the additive stream results in a target fuel octane value, and (ii) the additive stream comprises isopentane and n-pentane in a ratio and quantity that will not cause the octane of the ethanol enriched fuel stream to drop below the target fuel octane value when added at the additive stream flow rate. In certain embodiments, the ratio of n-pentane to isopentane and the quantity of mixed pentanes added to the fuel relative to the ethanol addition can be controlled to the point where the octane value of the ethanol-enriched fuel actually exceeds the target fuel octane value.

In another embodiment, the incoming fuel on a pipeline is monitored to determine when a new batch of fuel is arriving or when it has passed. One of the most useful physical properties for determining when a new batch has arrived is specific gravity. In one embodiment, the specific gravity in the fuel stream will be periodically measured, and significant differences in the specific gravity will be associated with the beginning and end time for a batch. This feature is especially useful when performing blending on a pipeline, where the fuel stream will include batches of fuel that cannot be expanded using the methods of the present invention, such as diesel fuel of transmix (referred to herein as a "zero allowance fuel stream"). When a batch of fuel arrives that cannot be expanded using the methods of the present invention, a stop signal will be generated and sent to the valves and pumps that control the additive stream. Alternatively, the blending logic could be written to calculate a zero flow rate for the additive stream, thereby causing the valves that control the flow the additive stream into the fuel stream to close.

The methods of the present invention can also be used to recommence the flow of the additive stream once a zero allowance fuel batch has passed. To prevent the inadvertent expansion of zero allowance fuel batches, the method may rely on the measurement of one or more physical properties of the fuel stream, such as specific gravity or volatility, to confirm that the zero allowance fuel batch has indeed passed. To be even safer, the method may include a delay after the physical property has been reached before blending can recommence, based on the passage of time or fuel volume after the physical property is reached, before the flow of the additive stream is allowed to recommence.

The additive stream is preferably under the control of three different pieces of equipment: a variable rate pump that transmits the additive stream from a storage medium such as a butane or pentane storage vessel, a metering valve preferably downstream of the pump that controls the actual flow rate of the additive stream into the fuel stream, and an on/off valve preferably downstream of the metering valve that allow the system to shut down and resume operations. The variable rate pump preferably transmits the additive stream at a pressure that is greater than the pressure inside the fuel line, based on periodic measurements taken on the fuel line and a fixed delta for the pressure difference between the two streams (i.e. 10-30 psi, 15-25 psi, or 20 psi).

All of the foregoing embodiments are preferably practiced on an automated basis using equipment that measures and transmits data on the physical properties of the streams to IPUs, information databases that store fixed data used by the IPUs to perform the logic, IPUs that manipulate the data to generate signals controlling the various processes, IPUs that generate data on the performance of the blending system and results of the blending process, and information databases to store the performance data in a format that is visible to an end user.

The central function of the IPUs is to execute the logic necessary for determining the rate of the additive fuel stream. Other functions performed by the IPUs include:

- receiving and processing the data necessary to execute the various functions;
- normalizing the volumetric flow rate of the fuel stream based on temperature data, and actualizing the additive flow rate and volume of additive blended based on temperature data;
- calculating the pressure at which the variable speed pump should be operating;
- processing instructions to start and stop the blending operation;
- determining suitable volatility limits based upon date information and data associating the date with the volatility limit;
- determining suitable volatility limits based upon geographic destination information; and
- generating results of the blending operation, and manipulating the results into a useable format.

Often the blending system will take advantage of information already being gathered by the pipeline operator or fuel distributor, in which case an IPU managed by the operator or distributor will communicate data to the blender IPU for use by the blender IPU in executing its functions. Information commonly transmitted from the operator or distributor IPU to the blender IPU includes, for example:

- date and time information, so that the dates and times used by the blender and operator or distributor IPUs are synchronous;
- pressure of the fuel stream;
- flow rate of the fuel stream;
- temperature of the fuel stream;
- batch start and stop times;
- type of fuel in the batch (sometimes provided as batch codes correlated with fuel type on the blender's IPU);
- the volume of fuel in the batch;
- the geographic destination of the batch; and
- on and off instructions.

The IPUs may store or have access to information databases storing numerous types of fixed data used in the blending process, including:

- allowable vapor pressures based on the destination of the fuel and the time of year;
- allowable distillation temperatures based on the destination of the fuel and the time of year;
- whether blending is permitted based upon the time of year or the destination of the batch; and
- whether blending is permitted based upon the type of fuel in a batch.

In operation, the blender's IPUs will access the corresponding date, fuel flow rate, fuel type and/or destination of the fuel stream, and calculate the additive flow rate based upon the allowable vapor pressure for the retrieved seasonal data, date, fuel type and/or destination for the fuel stream. Alternatively or in addition, the IPU may access a listing of fuels for which blending is impermissible, and dictate a zero blend rate or blend ratio based upon the fuel type that is passing the blending unit.

In addition, the IPUs control numerous physical operations of the blending process, including the valves, the upstream and downstream vapor pressure monitoring processes, the upstream and downstream distillation temperature monitoring processes, and the fuel sampling process. The one or more IPUs are thus logically programmed to execute one or more of the following physical processes:

- Modulate the on/off valve depending on whether blending is permitted;
- Modulate the orifice of the metering valve to accomplish the desired blending rate and ratio; and
- Modulate the pressure of the variable speed pump.

After performing various blending and monitoring functions, the blender's IPU will typically generate and consolidate data that describes the results of the blending process, correlates blending data with batch information supplied by the pipeline operator or fuel distributor, and validates the integrity and safety of the entire blending process, including:

- Vapor pressure and/or distillation temperature of gasoline upstream of the blending unit at particular times;
- Vapor pressure and/or distillation temperature of gasoline downstream of the blending unit at particular times;
- Settings for daily calibration of the fuel vapor pressure sensor(s);
- The date(s) of blending covered by the dataset;
- Batch start and end times;
- The quantity of additive blended into a fuel batch, on an actual and/or normalized basis;
- The type of fuel in a batch;
- Batch destination;
- Additive quantity stored in any storage units, given by date and time;
- Vapor pressure of additive at prescribed sampling times;
- Sulfur content of additive blended into the fuel;
- Metered volumes of additive withdrawn from any additive storage units for defined periods of time;
- Volumes of additive blended into the fuel stream, calculated from additive blend rates, for defined periods of time;
- The pressure of additive at two or more points between the additive storage unit and the additive blending unit; and
- The temperature of any additive storage vessel that supplies additive to the blending unit.

In one embodiment, this information is used to generate reports of lost blending opportunities, which might arise when, for example, the additive supply at the facility is depleted, the valves on the blending unit are inoperable, or some other malfunction. The presence of a central timing unit that can be used to track fuel batches is an important aspect of this embodiment because, by correlating the time with key attributes of the batches over time, one is able to correlate the lost blending opportunity to the key attribute, and thereby calculate the value of the lost blending opportunity. Key attributes of the flow that will affect the lost opportunity include the volatility of the fuel, which can be measured according to methods described elsewhere herein, the flow rate of the fuel, which can be monitored by the blender's IPU or the distributor's or operator's IPU, and the type of petroleum flowing through the pipeline, which will typically be derived from batch codes stored on a central IPU maintained at the facility, and received from an upstream source that has added the batch into the pipeline.

This information can be retrieved, stored and generated in report formats as required by the blender or pipeline operator or fuel distributor. In addition, all of this data is preferably accessible at a remote location through a suitably programmed IPU having an Internet connection.

In a preferred embodiment, fuel creation data (i.e. normalized additive consumption data) will preferably be accessed by an IPU controlled by the pipeline operator or fuel distributor, which will update the volume of any batch passing through the pipeline based on the addition of additive.

In a particular embodiment, the analyzing unit can generate a volatility signal based on the volatility, and the IPU can receive the volatility signal and calculate the flow rate of the additive stream based upon the volatility derived from the volatility signal and the flow rate of the fuel stream. Furthermore, the IPU can generate a blending signal based on the calculated rate of the additive stream; and the blending unit can receive the blending signal and blend the additive and fuel based upon the signal from the IPU.

The methods and systems of the present invention can employ data and programming that takes into account regulatory limits on volatility based on the time of year and geographical region, and automatically vary the blend ratio based on those limits. In a particular embodiment, the method can further comprise storing, in one or more informational databases, seasonal data that prescribes the fixed volatility requirement on two or more prescribed dates or ranges of dates; and calculating the rate or ratio of additive based upon current date information and the seasonal data. Likewise, in a particular embodiment, the system can further comprise one or more informational databases storing seasonal data that prescribes the fixed volatility requirement on two or more prescribed dates or ranges of dates. The IPU can receive this seasonal data, and calculate the rate or ratio of additive based upon current date information and the seasonal data.

Any of the foregoing data, including the fixed volatility requirements, volatility measurements, and the rate or ratio of additive can be stored in a database accessible to a remote location through a dedicated or Internet connection. Furthermore, any of the data or signals encoding the data can be transmitted via dedicated or Internet connections between the components of the system.

Discussion of Figures

Referring to FIG. 1, this is an illustration of an exemplary additive (pentane) blending system that operates at the distribution point that can be readily adapted to in-line applications and for use with mixed hydrocarbons such as mixed pentanes and various raw butane pools. In FIG. 1, the main components of the blending system are a pentane supply 110, a gasoline supply 115, an analyzing and blending unit 120, and a transport 125. The pentane supply 110 typically consists of a large vessel of pentane with lines for refilling with pentane and for drawing off pentane vapor. The pentane vessel will also generally have the appropriate safety valves, pressure gauges and temperature gauges. The pentane supply 110 feeds into the analyzing and measuring unit 120 through one or more pipelines.

The gasoline supply 115 typically consists of a large tank or plurality of tanks at the tank farm that supply gasoline to the analyzing and blending unit 120 through pipelines. The gasoline supply may consist of a series of tanks, each providing different grades of gasoline to the analyzing and blending unit 120.

Although they are shown as one unit in FIG. 1, the analyzing and blending unit 120 may comprise a separate analyzer and separate blender in alternative embodiments of the invention. Typically, the analyzing and blending unit 120 is triggered when a transport 125 selects a gasoline. The transport 125 connects to a rack which dispenses different grades of gasoline and a transport operator selects a particular grade. The analyzing and blending unit 120 draws samples from the pentane supply 110 and the gasoline supply 115 to determine how much pentane can be blended with the gasoline. The analyzing and blending unit 120 determines the maximum amount of pentane that can be blended with the gasoline based on the applicable logic. The maximum amount of pentane will typically correspond to the maximum volatility of the pentane as established by engine requirements or government regulations. Once the analyzing and blending unit 120 determines how much pentane to blend, the pentane is injected into the gasoline flowing from the gasoline supply 115. The blended combination then flows into the transport 125.

Figure 2:
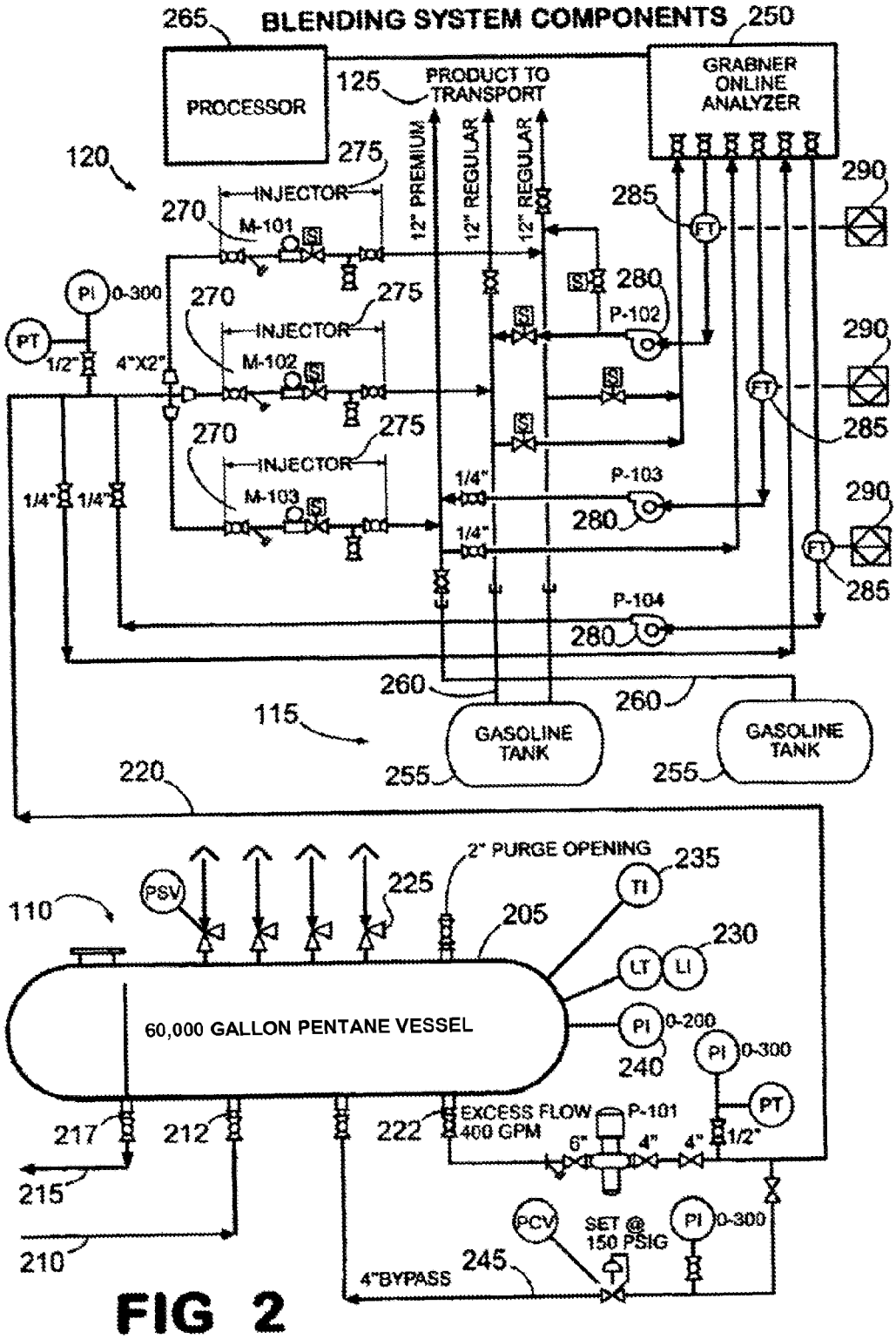
FIG. 2 is a functional block diagram illustrating the architecture and components of an exemplary embodiment of a mixed hydrocarbon blending system.

FIG. 2 is a schematic diagram illustrating in greater detail the exemplary pentane blending system described in FIG. 1, wherein the blending occurs at the point of distributing fuel to a tanker truck (i.e. at the rack). It will be understood that this design can be readily adapted to an in-line blending operation, and that mixed pentanes or raw butane or other mixed hydrocarbons can also be used in the system. Referring to FIG. 2, the pentane supply 110 comprises a pentane vessel 205, an inlet line 210, a vapor outlet line 215 and an outlet line 220. The pentane vessel 205 is filled with pentane through the inlet line 210. Vapor is released from the pentane vessel 205 through 30 the vapor outlet line 215. The pentane supply 110 may further comprise one or more pressure safety valves 225, a level indicator 230, temperature gauges 235, and pressure gauges 240.

Pentane is supplied to the analyzing and blending unit 120 by the outlet line 220. The pentane supply 110 may further comprise a bypass line 245 in fluid connection with the pentane vessel 205 and the outlet line 220. The bypass line 245 is operable for maintaining constant pressure in the outlet line 220.

The gasoline supply 115 is stored in one or more gasoline tanks 255 at the tank farm. Different tanks may contain different grades of gasoline. Gasoline is provided to the analyzing and blending unit 120 through one or more gasoline lines 260.

When a transport arrives at the tank farm, a transport operator selects a particular grade of gasoline for the transport load. Selection of a gasoline grade initiates the analyzing and blending process. A sample of pentane is drawn from the outlet line 220 and supplied to the analyzer 250 where the vapor pressure of the pentane is measured. Similarly, a sample of gasoline is drawn from the gasoline line 260 and supplied to the analyzer 250 where the vapor pressure of the gasoline is measured. In an alternative embodiment of the invention, the vapor-liquid ratio of the gasoline may be measured instead of, or in conjunction with the vapor pressure, to assess the volatility of the gasoline. Other embodiments of the invention may measure other physical characteristics to determine the volatility of the gasoline. A typical analyzer 250 is the Minivap Online analyzer manufactured by Grabner Instruments. Generally, one or more pumps 280 draw the pentane and gasoline samples into the analyzer 250. After the analyzer 250 takes measurements, the samples are returned to the pentane outlet line 220 and the gasoline line 260. The flow of the pentane and gasoline samples is monitored by flow transmitters 285. Data from the flow transmitters 285 may be communicated to a processor 265 via remote logic units 290 to ensure that there is a sample flow to the analyzer 250.

Once the volatility of the samples is measured, the analyzer 250 sends measurement data for the samples to the processor 265. The processor 265 calculates the amount of pentane that can be blended with the gasoline so that the maximum allowable volatility of the gasoline is not exceeded. The processor 265 is coupled to one or more programmable logic controllers 270 that control injectors 275. The injectors 275 are connected to the outlet line 220 and control the flow of pentane into the gasoline line 260. The blended gasoline then flows through the gasoline line 260 to the transport 125.

Figure 3:
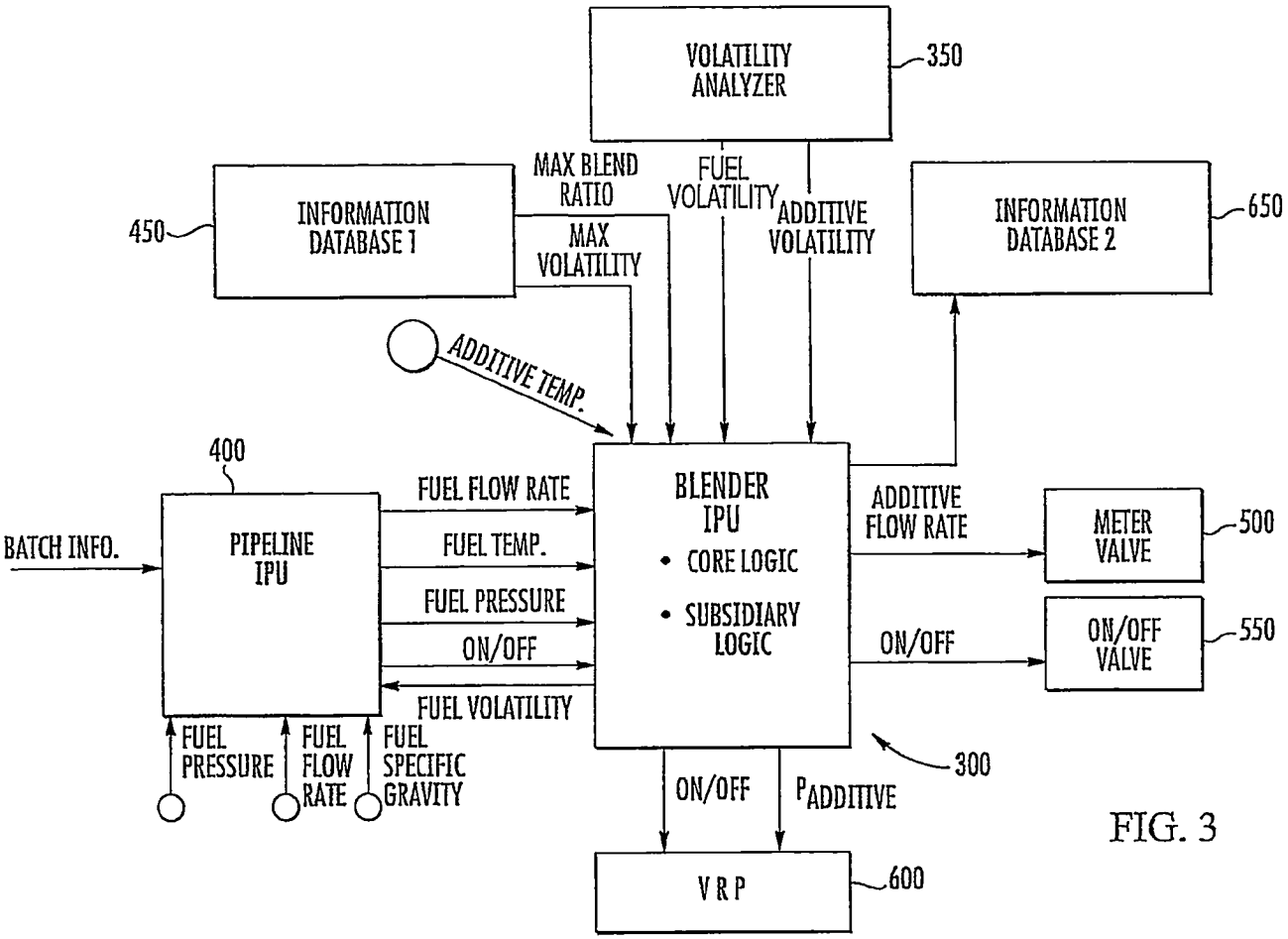
FIG. 3 is a logic flow diagram illustrating various databases and information processing units, and a pathway for the flow and processing of information and signals in an exemplary mixed hydrocarbon blending system.

Referring now to FIG. 3, a logic flow diagram is provided to illustrate an exemplary pathway for the flow and processing of information and signals through the various databases and IPUs. It should be appreciated that functions from multiple IPUs can be consolidated and vice versa, and that the function of one IPU can be performed on another IPU through appropriate computer programming and information gathering techniques. In the embodiment shown, there is a coordination of IPUs at the pipeline and blender level, so that the blender is able to take advantage of information gathered by the pipeline operator, and the pipeline operator is given ultimate control over the blending operation. However, it will be understood that the blender can gather all or any of the information itself, and perform the functions typically assigned to the pipeline operator.

Referring to FIG. 3, there is seen a Blender IPU 300 that houses the core logic and subsidiary logic of the system. The core logic receives physical parameters of the additive and fuel streams, including the volatility of the fuel stream and the additive stream from Volatility Analyzer 350, the temperature of the additive stream from measuring device 370, the flow rate, pressure and temperature of the fuel stream from the Pipeline IPU 400. The core logic also receives certain fixed limits from an Informational Database 450 including an allowable volatility of the blended stream and a maximum blend ratio of the additive and fuel streams. Based on the temperature and flow rate of the fuel stream, subsidiary logic normalizes the flow rate based on the flow rate at room temperature. The core logic then uses all of these parameters to calculate a normalized flow rate for the additive stream that does not exceed the allowable vapor pressure for the blend of the maximum blend rate. Subsidiary logic then converts the normalized flow rate to an actual flow rate based on the temperature of the additive stream, which is transmitted to a Meter Valve 500 on the additive fuel line for implementation.

Several variations on this logic are permissible, and encompassed within the scope of the invention. For example, the method could be performed without normalizing the flow rate of the fuel stream or the additive stream, in which case only actual flow rates would be used and calculated. In addition, it is not always necessary to measure the volatility of the additive stream. Rather, a fixed value can be assigned to the volatility of the additive stream and recorded in Informational Database 400, and this fixed value communicated to IPU 300.

Other subsidiary logic housed on the Blender IPU 300 is written to receive on and off signals from the Pipeline IPU 400, and to signal the blending equipment either to start or stop based on the instructions from the Pipeline IPU 400. As shown in FIG. 3, the signal is transmitted to an On/Off Valve 550 situated on the additive fuel line for implementation. A corresponding start or stop signal is issued to Variable Rate Pump 600 based on the instructions from the Pipeline IPU 400. Once again, several variations are permitted to this subsidiary logic depending on the design of the physical systems. For example, a single rate pump could be used instead of a variable rate pump, or the variable rate pump could be omitted in its entirety.

Other subsidiary logic on Blender IPU 300 can be written to process the fuel line pressure received from Pipeline IPU 400. As noted elsewhere in this document, it is generally preferred to supply the additive fuel at a designated pressure above the pressure of the fuel line, such as 20 psi. The subsidiary logic converts the pressure of the fuel line to an additive line pressure, and transmits the additive line pressure to Variable Rate Pump 600 for implementation.

Still other subsidiary logic can be written to transmit fuel volatility measurements from the volatility analyzer to the Pipeline IPU 400. These measurements can be taken upstream or downstream of the fluid connection between the additive and fuel streams, and used by the pipeline IPU to generate start and stop signals and discussed in greater detail below.

Other subsidiary logic can be written on the Blender IPU 300 that generates data on the blending operation, such as batch information for each batch of additive, and other information described herein. This data is transmitted to Informational Database 600, where it is stored and printed or reconfigured and formatted into report formats requested by the user.

Pipeline IPU 400 plays a critical role in the oversight of the blending process, to ensure that the pipeline's quality requirements are not compromised. It also plays an instrumental role in gathering information used by the Blender IPU 300. Based on information it receives from various sources, including its own monitoring of physical parameters of the fuel flowing through the pipeline, and its knowledge of the characteristics of batches flowing through the pipeline, Blender IPU 300 is able to generate start signals to Blender IPU 300 to resume blending when permissible batches are flowing past the fluid connection with the additive stream, and stop signals to halt blending when impermissible batches are flowing past the fluid connection. Based on volatility measures received from Blender IPU 300, or specific gravity measures received directly from the fuel line, the Pipeline IPU can determine when a batch of fuel begins and ends, and generate a start or stop signal at the appropriate time.

EXAMPLES

The following examples are put forth so as to provide those of ordinary skill in the art with a complete disclosure and description of how the methods claimed herein are made and evaluated, and are intended to be purely exemplary of the invention and are not intended to limit the scope of what the inventor regards as his invention. Efforts have been made to ensure accuracy with respect to numbers (e.g., amounts, temperature, etc.) but some errors and deviations should be accounted for.

Example 1

The following Table 1A summarizes the aromatic effect typically observed from addition of hydrocarbons to a gasoline stream:

TABLE 1A

RVP BLENDING VALUES

| | rvp | vol % (aromatics) | | | | | |
|---|---|---|---|---|---|---|---|
| | (pure HC) | 0 | 10 | 20 | 30 | 40 | 50 |
| Ethane | 730.0 | 474.0 | 474.0 | 474.0 | 474.0 | 474.0 | 474.0 |
| Propene | 226.0 | 216.0 | 216.0 | 216.0 | 216.0 | 216.0 | 216.0 |
| Propane | 190.0 | 173.0 | 173.0 | 173.0 | 173.0 | 173.0 | 173.0 |
| Isobutane | 72.2 | 62.0 | 73.9 | 85.4 | 96.6 | 107.6 | 118.8 |
| Isobutene | 63.4 | 76.5 | 78.9 | 81.3 | 83.7 | 86.2 | 88.9 |
| Butene-1 | 63.0 | 76.1 | 78.4 | 80.8 | 82.7 | 85.1 | 87.4 |
| n-Butane | 51.6 | 52.9 | 55.6 | 58.3 | 60.9 | 63.5 | 66.2 |
| trans-2-Butene | 49.8 | 62.1 | 64.0 | 66.0 | 68.0 | 70.0 | 72.0 |
| cis-2-Butene | 45.5 | 58.6 | 60.5 | 62.3 | 64.2 | 66.1 | 69.0 |
| Isopentane | 20.4 | 21.9 | 22.2 | 22.5 | 22.9 | 23.3 | 23.7 |
| $C_5$ olefins* | 16.5 | 17.9 | 18.1 | 18.4 | 18.6 | 18.8 | 19.0 |
| n-Pentane | 15.6 | 16.9 | 17.2 | 17.4 | 17.8 | 18.0 | 18.2 |

Table 1B summarizes relevant physical properties associated with pentane blending into gasoline:

TABLE 1B

| | Boiling Pt (° F.) | RVP | TV/L = 20 | Neat Octane (R + M/2) | Blending Octane (R + M/2) |
|---|---|---|---|---|---|
| n-butane | 31 | 55 | negative | 92 | 92 |
| n-pentane | 97 | 16 | 87 | 65 | >65 |
| neopentane | 49 | 20 | 50 | 83 | >83 |
| isopentane | 82 | 35 | 1 | 91 | 91 |

Example 2

Unleaded regular and premium gasoline blends satisfying the performance characteristics of ASTM D4814-01a were blended with varying amounts of a mixed pentane stream containing 55% n-pentane and 45% iso-pentane (hereinafter referred to as "mC5"), a 55:45 mixture of the butane and mC5, a 80:20 mixture of the butane and mC5, and the resulting blends measured for RVP and octane. The same blends were subsequently mixed with 10% ethanol and their RVP and octane values measured a second time. RVP and octane values of the starting gasoline and resulting blends are reported below in Tables 2A-2F.

All RVP values reported in the following examples were measured according to ASTM D 5191. Octane is reported as (R+M)/2, where R equals the research octane number calculated according to ASTM D 2699, and M equals the motor octane number calculated according to ASTM D 2700. Butane used in all blends was n-butane.

TABLE 2A

| | CBOB | CBOB + EtOH | PBOB | PBOB + EtOH |
|---|---|---|---|---|
| RVP | 5.82 | 7.25 | 5.28 | 6.54 |
| +4.5% mC5 | 6.64 | — | 6.05 | — |
| +12% mC5 | 7.24 | 8.7 | 7.24 | 8.37 |
| +15% mC5 | 7.82 | — | 7.31 | — |

TABLE 2B

| | CBOB | CBOB + EtOH | PBOB | PBOB + EtOH |
|---|---|---|---|---|
| RVP | 5.82 | 7.25 | 5.28 | 6.54 |
| +3% 55/45 | 6.92 | 7.99 | 6.48 | 7.75 |
| +8% 55/45 | 8.37 | — | 8.48 | — |
| +11% 55/45 | 9.94 | 10.83 | 9.36 | 10.21 |

TABLE 2C

| | CBOB | CBOB + EtOH | PBOB | PBOB + EtOH |
|---|---|---|---|---|
| RVP | 5.82 | 7.25 | 5.28 | 6.54 |
| +2% 80/20 | 6.61 | — | 6.44 | — |
| +6% 80/20 | 8.43 | 9.7 | 8.48 | 9.07 |
| +9% 80/20 | 9.91 | — | 9.47 | — |

TABLE 2D

| | CBOB | CBOB + EtOH | PBOB | PBOB + EtOH |
|---|---|---|---|---|
| Octane | 83.2 | 87.0 | 91.2 | 93.1 |
| +4.5% mC5 | 83.0 | — | 91.0 | — |

TABLE 2D-continued

| | CBOB | CBOB + EtOH | PBOB | PBOB + EtOH |
|---|---|---|---|---|
| +12% mC5 | 83.0 | 86.6 | 91.0 | 93.2 |
| +15% mC5 | 83.0 | — | 91.0 | — |

TABLE 2E

| | CBOB | CBOB + EtOH | PBOB | PBOB + EtOH |
|---|---|---|---|---|
| Octane | 83.2 | 87.0 | 91.2 | 93.1 |
| +3% 55/45 | 83.6 | 87.2 | 91.5 | 93.3 |
| +8% 55/45 | 83.6 | — | 91.2 | — |
| +11% 55/45 | 83.5 | 87.5 | 91.1 | 93.5 |

TABLE 2F

| | CBOB | CBOB + EtOH | PBOB | PBOB + EtOH |
|---|---|---|---|---|
| Octane | 83.2 | 87.0 | 91.2 | 93.1 |
| +2% 80/20 | 83.4 | — | 91.2 | — |
| +6% 80/20 | 83.5 | 87.5 | 91.0 | 93.6 |
| +9% 80/20 | 83.5 | — | 90.8 | |

TABLE 2G

| | CBOB | CBOB + EtOH | PBOB | PBOB + EtOH |
|---|---|---|---|---|
| RVP | 11.12 | 12.89 | 11.2 | 11.98 |
| +4% mC5 | 11.4 | 12.4 | 11.24 | 12.1 |
| +7% mC5 | 11.37 | 12.63 | 11.5 | 12.2 |
| +12% mC5 | 11.66 | 12.83 | 11.56 | 12.49 |

TABLE 2H

| | CBOB | CBOB + EtOH | PBOB | PBOB + EtOH |
|---|---|---|---|---|
| RVP | 11.12 | 12.89 | 11.2 | 11.98 |
| +6% 55/45 | 12.3 | 13.87 | 12.46 | 13.16 |
| +8% 55/45 | 13.05 | 14.21 | 13.47 | 14.14 |
| +9% 55/45 | 13.34 | 14.68 | 13.71 | 14.27 |

TABLE 2I

| | CBOB | CBOB + EtOH | PBOB | PBOB + EtOH |
|---|---|---|---|---|
| RVP | 11.12 | 12.89 | 11.2 | 11.98 |
| +9% 80/20 | 14.17 | 15.16 | 13.94 | 13.84 |
| +12% 80/20 | 15.32 | 15.75 | 14.62 | 14.24 |
| +13% 80/20 | 15.58 | 16.82 | 14.89 | 15.59 |

TABLE 2J

| | CBOB | CBOB + EtOH | PBOB | PBOB + EtOH |
|---|---|---|---|---|
| Octane | 84.1 | 87.4 | 92.3 | 94.4 |
| +4% mC5 | 87.9 | 87.6 | 92.4 | 94.5 |
| +7% mC5 | 87.8 | 87.3 | 92.4 | 94.4 |
| +12% mC5 | 87.5 | 87.1 | 92.2 | 93.9 |

TABLE 2K

| | CBOB | CBOB + EtOH | PBOB | PBOB + EtOH |
|---|---|---|---|---|
| Octane | 84.1 | 87.4 | 92.3 | 94.4 |
| +6% 55/45 | 84 | 87.6 | 92.5 | 94.5 |

TABLE 2K-continued

| | CBOB | CBOB + EtOH | PBOB | PBOB + EtOH |
|---|---|---|---|---|
| +8% 55/45 | 84.1 | 87.5 | 92.3 | 94.1 |
| +9% 55/45 | 84.2 | 87.5 | 92.2 | 94.1 |

TABLE 2L

| | CBOB | CBOB + EtOH | PBOB | PBOB + EtOH |
|---|---|---|---|---|
| Octane | 84.1 | 87.4 | 92.3 | 94.4 |
| +9% 80/20 | 84.3 | 87.6 | 92.4 | 94.4 |
| +12% 80/20 | 84.2 | 87.6 | 92.4 | 94.3 |
| +13% 80/20 | 84.3 | 87.6 | 92.5 | 94.1 |

Three notable findings emerge from the foregoing tables. The first emerges from Table 2D, wherein it is seen that isopentane stabilizes the impact of n-pentane on the resulting blend, across the entire range of quantities tested. In spite of a neat octane value of approximately 65 for n-pentane, the n-pentane added to the blend had very little impact on the octane of the resulting blend due to the presence of isopentane.

The second finding relates to the impact of the mixed hydrocarbons (C4 and C5) on octane as the amount of pentanes increases, when added to a hydrocarbon stream that is eventually mixed with ethanol. This can be seen most clearly from the data in Tables 2E and 2F. As a general rule, increasing the quantity of mixed hydrocarbons (C4 and C5) either decreased the final octane value slightly or had no effect on the final octane value of the mixture. However, when ethanol was added to the blend a reversal to the trend was observed, with the ethanol blended octane value increasing with the additional mixed hydrocarbons. Indeed, synergy is observed at various blending rates, and is observed sooner (from a pentane standpoint) when the pentane is mixed with larger proportions of butane.

The third finding relates to the consistency of the impact on octane as the ratio of butane and pentane components is varied. In fact, varying the ratio of butane to mixed pentanes had very little impact on the octane value of the resulting blend, demonstrating that RVP can be used as the controlling variable when a range of butane/pentane batches is added to the gasoline.

Example 3

The following iterative procedure described in "How to Estimate Reid Vapor Pressure (RVP) of Blends," J. Vazquez-Esparragoza, Hydrocarbon Processing, August 1992, can be used to predict the RVP of a mixture of hydrocarbon components. Importantly, the procedure can be used for hydrocarbon components defined by either their chemical composition or their physical properties. For this reason, it can be used to calculate the volatility of a blend of (1) butane, which has a known chemical composition, (2) mixed pentanes or raw butane, and (3) a mixture of gasoline, butane and mixed pentanes, which has an unknown chemical composition, but can be defined by its physical properties obtained from a volatility analysis. Advantageously, the algorithm can by implemented in a computer simulation.

Step 1. Calculate the molecular weight (MW) of the sample mixture:

$$MW_{mix}=\Sigma_i x_i MW_i$$

Step 2. Evaluate the density (ρ) of the sample at T=35, 60, and 100° F. Compute the liquid expansion of the sample using n=4:

$$V_o=\rho_{60}((n+1)/\rho_{35}-1/\rho_{100})$$

Step 3. Make a flash calculation at 100° F. For the first calculation, assume an initial ratio of the equilibrium liquid L and feed liquid F so that L/F=0.97.

Step 4. Using the values from step 3, calculate a new L/F with the equation:

$$L/F=1/(1+(\rho_V MW_L/\rho_L MW_V)(V_o/(\rho_V/\rho_{LF})))$$

Step 5. Use the value of L/F from step 4 to recalculate the flash from step 3 and a new value of L/F from step 4. In most cases, the assumed and calculated values agree within the specified criterion within less than five iterations.

Step 6. The RVP is the flash pressure for the value of L/F obtained by iteration.

Throughout this application, various publications are referenced. The disclosures of these publications are hereby incorporated by reference in order to more fully describe the state of the art to which this invention pertains. It will be apparent to those skilled in the art that various modifications and variations can be made in the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

The invention claimed is:

1. A method for making fuel enriched by mixed pentanes comprising the steps:

a) providing a fuel blending unit characterized by:
   i) a first enclosed conduit transmitting a fuel stream, and
   ii) a second enclosed conduit transmitting an additive stream having a positive vapor pressure blend value on the fuel stream, wherein the additive stream comprises n-pentane and isopentane at a ratio of from 1:4 to 4:1, and
   iii) an outlet in the second enclosed conduit forming a fluid connection with an inlet in the first enclosed conduit, b) providing:
   i) a volatility for the additive stream (the "additive stream volatility"),
   ii) a flow rate for the fuel stream (the "fuel stream flow rate"),
   iii) an octane value for the fuel stream (the "fuel stream octane value"), and
   iv) a maximum blended volatility for the fuel stream (the "maximum blended volatility"), c) measuring the fuel stream for its actual volatility (the "fuel stream volatility"), upstream or downstream of the fluid connection, d) calculating a rate (the "additive stream flow rate") at which the additive stream can be added to the fuel stream so as not to exceed the maximum blended volatility, wherein the calculating is based upon:
   i) the fuel stream volatility,
   ii) the additive stream volatility, and
   iii) the fuel stream flow rate, and e) adding the additive stream to the fuel stream at the additive stream flow rate at the fluid connection to make pentane enriched fuel having a final octane value, wherein said ratio of isopentane to n-pentane in said mixed pentane stream is adequate to overcome the depression in octane induced by said n-pentane, such that the n-pentane does not cause the final octane value to drop below the fuel stream octane value.

2. A method for making mixed pentane enriched fuel without depressing the octane of the fuel, comprising the steps:

a) providing a fuel blending unit characterized by:
   i) a first enclosed conduit transmitting a fuel stream,
   ii) a second enclosed conduit transmitting an additive stream having a positive vapor pressure blend value on the fuel stream, wherein the additive stream comprises mixed pentanes comprising n-pentane and isopentane at a ratio of from 1:5 to 5:1, and
   iii) an outlet in the second enclosed conduit forming a fluid connection with an inlet in the first enclosed conduit, b) providing:
   i) a volatility for the additive stream (the "additive stream volatility"),
   ii) a flow rate for the fuel stream (the "fuel stream flow rate"),
   iii) an octane value for the fuel stream (the "fuel stream octane value"), and
   iv) a maximum blended volatility for the fuel stream (the "maximum blended volatility"), c) measuring the fuel stream for its actual volatility (the "fuel stream volatility") upstream or downstream of the fluid connection, d) calculating a rate (the "additive stream flow rate") at which the additive stream can be added to the fuel stream so as not to exceed the maximum blended volatility, wherein the calculating is based upon:
   i) the fuel stream volatility,
   ii) the additive stream volatility, and
   iii) the fuel stream flow rate, e) adding the additive stream to the fuel stream at the additive stream flow rate at the fluid connection to make a volume of pentane enriched fuel, and f) adding ethanol to the pentane enriched fuel in an ethanol volume sufficient to overcome the depression in octane caused by n-pentane in the mixed pentanes, wherein the ethanol volume is at least 5% of the volume of said pentane enriched fuel.

3. The method of claim 1, further comprising providing a maximum addition rate at which the additive stream can be added to the fuel stream so as to prevent the final octane value from dropping below the fuel stream octane value, wherein the additive stream flow rate is calculated so as not to exceed the maximum blended volatility or the maximum addition rate.

4. The method of claim 1, wherein:

i) the fuel stream is intended for ethanol enrichment with a fixed amount of ethanol, thereby creating an ethanol enriched fuel stream, wherein the ethanol enrichment of the fuel stream without adding the additive stream results in a target fuel octane value, and ii) the additive stream comprises isopentane and n-pentane in a ratio and quantity that will not cause the octane of the ethanol enriched fuel stream to drop below the target fuel octane value when added at the additive stream flow rate.

5. The method of claim 1, wherein:

i) the fuel stream is intended for ethanol enrichment with a fixed amount of ethanol, thereby creating an ethanol enriched fuel stream, wherein the ethanol enrichment of the fuel stream without adding the additive stream results in a target fuel octane value, and ii) the additive stream comprises isopentane and n-pentane in a ratio and quantity that causes the octane of the ethanol enriched fuel stream to exceed the target fuel octane value when added at the additive stream flow rate.

6. The method of claim 1, further comprising controlling the ratio of isopentane to n-pentane in the additive stream.

7. The method of claim 1, wherein the additive stream comprises a plurality of batches, further comprising controlling the ratio of isopentane or n-pentane in the additive stream by:

i) providing a minimum isopentane:n-pentane ratio,
ii) measuring the actual isopentane:n-pentane ratio in each of the batches, and
iii) rejecting any of the batches that fall below the minimum isopentane:n-pentane ratio prior to addition to the additive stream.

8. The method of claim 1, wherein the additive stream comprises isopentane and n-pentane in a ratio of from 40:60 to 50:50.

9. The method of claim 1, wherein the additive stream comprises greater than 50%/C5.

10. The method of claim 1, wherein the additive stream comprises greater than 50% butane and greater than 5% mixed pentanes.

11. The method of claim 1 wherein the additive stream comprises greater than 50% butane and greater than 30% mixed pentanes.

12. The method of claim 1 wherein the additive stream comprises greater than 50% butane and greater than 30% mixed pentanes comprising at least 25% n-pentane.

13. The method of claim 1, wherein the additive stream flow rate is from 5% to 15% of the fuel stream flow rate.

14. The method of claim 1, wherein the additive stream comprises a plurality of batches, further comprising controlling the volatility of the batches in the additive stream by:

a) providing a maximum volatility for the additive stream;
b) measuring the volatility of the batches; and
c) rejecting any batch in which the volatility exceeds the maximum volatility for the additive stream.

15. The method of claim 1, wherein the additive stream volatility is a maximum designated volatility, and the additive stream further comprises an actual volatility that varies over time but does not exceed the maximum fixed volatility.

16. The method of claim 1, further comprising periodically repeating steps (c) and (d), and periodically adjusting the additive stream flow rate in step (e) according to the most recent calculation in step (d).

17. The method of claim 1 wherein the additive stream volatility is an actual volatility, further comprising periodically measuring the additive stream volatility.

18. The method of claim 1, further comprising:

a) periodically measuring the temperature of the additive stream,
b) calculating the additive stream flow rate based upon the temperature of the additive stream.

19. The method of claim 1, further comprising periodically measuring the fuel stream flow rate upstream of the fluid connection.

20. The method of claim 1, wherein the fuel stream fuel rate is a normalized fuel rate that accounts for the temperature of the fuel stream.

21. The method of claim 1, further comprising periodically measuring the fuel stream flow rate downstream of the fluid connection.

22. The method of claim 1 wherein the measuring step (c) is performed upstream of the inlet in the first enclosed conduit.

23. The method of claim 1, wherein the measuring step (c) is performed downstream of the inlet in the first enclosed conduit, and said calculating step (d) is based on downstream feedback control.

24. The method of claim 1, wherein the fuel stream comprises a plurality of batches of different fuel types, wherein the start of a batch and the end of a batch are determined based upon differences in specific gravity observed in the fuel stream.

25. The method of claim 1, wherein the fuel stream comprises a plurality of batches of different fuel types, further comprising:

a) providing a maximum rate for the additive stream of zero for certain fuel types ("zero allowance fuels"), b) providing information that correlates a batch of a zero allowance fuel with the batch's specific gravity, c) determining the start of a. zero allowance fuel batch and the end of a zero allowance fuel batch based upon the information provided in step (b), and measurements of specific gravity in the fuel stream, and d) ceasing the flow of the additive stream to the fluid connection upon receiving a zero allowance fuel batch.

26. The method of claim 25, further comprising recommencing the flow of the additive stream upon satisfaction of the following conditions ("the recommended conditions"):

a) receipt of a fuel batch other than a zero allowance fuel batch (the "new fuel batch"), and b) receipt of at least one physical property measurement from the fuel stream confirming receipt of the new fuel batch.

27. The method of claim 26, wherein the recommencement conditions further include passage of a minimum volume of fuel past the fluid connection after receipt of the physical property measurement of condition (b).

28. The method of claim 1 performed on a fuel transmission line downstream of a refinery and upstream of a plurality of bulk petroleum storage tanks.

29. The method of claim 1, performed on a fuel transmission line downstream of a refinery and downstream of a plurality of bulk petroleum storage tanks downstream of a refinery.

30. The method of claim 1 performed on a fuel transmission line dedicated to one fuel type at the rack of a fuel distribution facility.

31. The method of claim 1 wherein the additive stream comprises a plurality of heterogeneous batches.

32. The method of claim 1, wherein the fuel stream meets the requirements of ASTM D4814 or, upon mixing with a prescribed volume of ethanol, meets the requirements of ASTM D4814.

33. The method of claim 1, further comprising providing an automated sampling device and one or more information processing units ("IPUs"), wherein:

i) the measurement step (c) is performed by the automated sampling device by periodically extracting samples from the fuel stream, measuring the actual volatility of the samples, and transmitting the actual volatility of the fuel stream to the IPU, ii) the flow rate of the fuel stream is measured periodically by an automated flow meter that transmits a signal corresponding to the flow rate of the fuel stream to an IPU, iii) the calculating step (d) is performed on an IPU based on logic encoded in the unit, the actual volatility received from the sampling device, and the flow rate of the fuel stream received from the metering device, and iv) the IPU generates a signal based upon said calculating step (d) corresponding to the additive stream flow rate, and transmits the signal to one or more automated valves that modulate the flow of additive through the additive stream line.

34. The method of claim 33, further comprising providing thermometers on the additive and fuel streams that periodically measure the temperatures of the additive and fuel streams, wherein, a) signals corresponding to the temperatures are periodically transmitted to the one or more IPUs, b) the one or more IPUs normalize the fuel stream flow rate based on the temperature of the flow rate, and the normalized flow rate is used in calculating step (d), and c) calculating step (d) yields a normalized flow rate for said additive stream, and said one or more IPUs converts the normalized flow rate is translated to the additive stream flow rate based on the temperature of the additive stream.

35. The method of claim 33, further comprising providing one or more databases on which are stored a designated volatility for the additive stream, a maximum volatility for the fuel stream, and a maximum addition rate for the additive stream, wherein:

i) one or more signals corresponding to the designated volatility of the additive stream, the maximum volatility of the fuel stream and the maximum addition rate for the additive stream are transmitted from the one or more databases to an IPU, and ii) calculating step (d) is based on the designated volatility of the additive stream and the maximum volatility of the fuel stream and the maximum addition rate for the additive stream transmitted from the one or more databases.

36. The method of claim 33 further comprising providing one or more databases for storing results of the method, wherein the one or more IPUs receive data corresponding to the start and stop times of batches within the fuel stream, calculate the total normalized quantity of additive blended between the start and stop times, correlate the total normalized quantity of additive blended to the batch, and transmit the correlation to the one or more databases.

37. The method of claim 33 further comprising providing an operator IPU and a blender IPU, wherein the operator IPU is logically programmed to:

a) transmit start and stop times associated with fuel stream batches to the blender IPU, b) transmit instructions to start and stop blending to the blender IPU, and c) periodically receive and transmit the fuel flow rate to the blender IPU.

38. The method of claim 2, wherein the measuring step (c) is performed downstream of the inlet in the first enclosed conduit, and said calculating step (d) is based on downstream feedback control.

* * * * *